US005981457A

United States Patent [19]

Ahmed

[11] Patent Number: 5,981,457

[45] **Date of Patent: *Nov. 9, 1999**

[54] CONCENTRATED LIQUID GEL WAREWASH DETERGENT

[75] Inventor: Fahim U. Ahmed, Greensboro, N.C.

[73] Assignee: Kay Chemical Company, Greensboro, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/792,264

[22] Filed: Jan. 31, 1997

Related U.S. Application Data

[63] Continuation of application No. 08/395,875, Feb. 28, 1995, abandoned.

[51] Int. Cl.[6] ..... C11D 3/04; C11D 3/37; C11D 3/395

[52] U.S. Cl. ..... 510/223; 510/221; 510/230; 510/231; 510/233; 510/379; 510/380; 510/370; 134/25.2

[58] Field of Search ..... 510/221, 223, 510/230, 231, 233, 379, 380, 370; 134/25.2

[56] References Cited

U.S. PATENT DOCUMENTS

| | | | |
|---|---|---|---|
| 3,583,922 | 6/1971 | McClain et al. | 252/99 |
| 3,749,672 | 7/1973 | Golton et al. | 252/95 |
| 4,201,687 | 5/1980 | Crutchfield et al. | 252/102 |
| 4,512,908 | 4/1985 | Heile | 252/160 |
| 4,578,119 | 3/1986 | Marcus et al. | 134/4 |
| 4,992,195 | 2/1991 | Dolan et al. | 252/99 |
| 5,053,158 | 10/1991 | Dixit et al. | 252/99 |
| 5,064,553 | 11/1991 | Dixit et al. | 252/94 |
| 5,229,027 | 7/1993 | Ahmed | 252/99 |
| 5,252,241 | 10/1993 | Dixit et al. | 252/94 |
| 5,252,242 | 10/1993 | Shevade et al. | 252/97 |
| 5,298,180 | 3/1994 | Dixit | 252/94 |
| 5,368,776 | 11/1994 | Schafer et al. | 252/393 |

FOREIGN PATENT DOCUMENTS

| | | |
|---|---|---|
| 0 3 22 946 A3 | 12/1988 | European Pat. Off. . |
| 0 541 201 A1 | 11/1991 | European Pat. Off. . |
| 0 510 945 A3 | 10/1992 | European Pat. Off. . |
| 0 574 236 A2 | 12/1993 | European Pat. Off. . |
| WO 94/29428 | 12/1994 | WIPO . |

*Primary Examiner*—Yogendra Gupta
*Assistant Examiner*—Gregory R. Delcotto
*Attorney, Agent, or Firm*—Finnegan, Henderson, Farabow, Garrett & Dunner, L.L.P.

[57] ABSTRACT

The present invention relates to a concentrated liquid gel warewash detergent composition which contains about 5% to about 30% by weight of an alkali polyphosphate, about 8% to about 50% by weight of a source of alkalinity, about 0% to about 5% by weight of a surface active agent, about 0.1% to about 2% by weight of a hydrophilic crosslinkled polycarboxylate thickening agent, about 0.1% to about 2% by weight of a hydrogen bonding agent for the polycarboxylate, and about 0 to about 15% of a polyacrylate, the balance being water. The composition may also contain about 0% to about 3% by weight of a chlorine bleach. The composition is predissolved and can be accurately metered into warewash machines to clean and destain tablewares and dishwares.

17 Claims, No Drawings

CONCENTRATED LIQUID GEL WAREWASH DETERGENT

This application is a continuation of application Ser. No. 08/395,875, filed Feb. 28, 1995, now abandoned.

FIELD OF THE INVENTION

The invention relates generally to highly alkaline concentrated liquid gel cleaner, stabilized by a polycarboxylate thickening agent, that can be accurately metered into warewash machines to clean and destain tablewares including glasswares, flatwares, plates, pots and pans.

BACKGROUND OF THE INVENTION

Liquid dishwasher detergent compositions, both aqueous and nonaqueous, have achieved commercial popularity for use in household automatic dishwashers. Representative of such detergent compositions are the automatic dishwasher compositions disclosed in U.S. Pat. Nos. 5,209,863; 5,219,486; 5,225,096; 5,246,615; 5,252,241; and 5,252,242, the disclosures of which are herein incorporated by reference.

These compositions, however, are not useful for institutional and industrial cleaning, which are characterized by short wash cycles and both low and high temperatures. The low concentrations of caustic alkali and, when present, chlorine bleach make the household products ineffective for institutional and industrial applications. Moreover, sodium silicate, a key ingredient in household products to inhibit corrosion, is not generally used in institutional and industrial products for machines having very short wash cycles as it tends to leave a cloudy film on wares and machines over time.

Furthermore, products which are used in institutional and industrial cleaning applications have their own particular disadvantages. For example, solid brick detergent compositions, such as those disclosed in U.S. Pat. Nos. 4,569,780; 4,569,781; 4,753,755; 4,808,236; 4,846,989; and 5,080,819, the disclosures of which are herein incorporated by reference, are all solid blocks which must be predissolved with hot water before they can be pumped into a warewash machine. Considering the very short wash times employed with these machines, e.g., <1 minute, performance is compromised when a portion of the wash cycle is devoted to dissolving the detergent and pumping it into the machine.

Similarly, the solid paste composition disclosed in U.S. Pat. No. 5,019,290, the disclosure of which is herein incorporated by reference, is very thick and cannot be pumped. Accordingly, as with the solid brick products, the desired amount of detergent must be dissolved with hot water and then transferred into the machine.

The liquid emulsion product disclosed in U.S. Pat. No. 4,512,908, the disclosure of which is herein incorporated by reference, is a low viscosity, pumpable, non-concentrated liquid containing a clay thickener. The long term stability of this product is uncertain.

There is, therefore, a need in the art for a stable concentrated liquid gel warewash which is predissolved and dispensable through a metered device and has high level of caustic alkali and other active ingredients for use in institutional and industrial cleaning applications.

SUMMARY OF THE INVENTION

Accordingly, the present invention is directed to a concentrated liquid gel warewash composition that can be used in institutional and industrial cleaning applications. The inventive composition has the particular advantages of being a predissolved concentrated gel, which is easily pumped and metered and goes to work instantly. In addition to convenience, the inventive composition also has the aesthetic appeal of a gel.

Additional features and advantages of the invention will be set forth in the description which follows, and in part will be apparent from the description or may be learned from practice of the invention. The advantages of the invention will be realized and attained by the composition particularly pointed out in the written description and claims.

To achieve these and other advantages and in accordance with the purpose of the invention, as embodied and broadly described, the invention provides a concentrated liquid gel warewash detergent composition which contains an alkali metal detergent builder salt, a source of alkalinity, a neutralized crosslinked hydrophilic polymeric thickening agent, and a hydrogen bonding agent for this polymeric thickening agent, the balance of the composition being water. The present composition may also optionally contain a water dispersible or water soluble surface active agent, a chlorine bleach compound and/or a noncrosslinked polyacrylate. The composition is characterized by its linear viscoelastic properties, substantial stability against phase separation and substantial absence of unbound water.

It is to be understood that both the foregoing general description and the following detailed description are exemplary and explanatory and are intended to provide further explanation of the invention as claimed.

DETAILED DESCRIPTION OF THE INVENTION

A first embodiment of the present invention is directed to a concentrated liquid gel warewash detergent composition which contains about 5% to about 30% by weight of an alkali metal detergent builder salt, about 8% to about 50% by weight of a source of alkalinity, about 0% to about 5% by weight of a water dispersible or water soluble organic surface active agent, about 0.1% to about 2% by weight of a neutralized crosslinked hydrophilic polycarboxylate thickening agent, about 0% to about 15% by weight of a noncrosslinked polyacrylate and about 0.1% to about 2% by weight of a hydrogen bonding agent for the polycarboxylate thickening agent, the balance of the composition being water. The composition may also contain a chlorine bleach compound in an amount effective to provide up to about 5% available chlorine. The composition is a predissolved gel which can be accurately dispensed using a metered dispenser such as peristaltic pump.

The alkali metal detergent builder salt is preferably one of the alkali polyphosphates known to the art as detergent builder salts. Illustrative examples include, but are not limited to, alkali metal pyrophosphates (e.g., tetrasodium or tetrapotassium pyrophosphate), alkali metal tripolyphosphates (e.g., sodium or potassium tripolyphosphate, either hydrated or anhydrous), and alkali metal metaphosphates (e.g., sodium or potassium hexametaphosphate), and the like (e.g., trisodium or tripotassium orthophosphate and the like). The amount of alkali metal polyphosphate employed is preferably about 5% to about 25% by weight of the composition, more preferably about 10% to about 20% by weight.

Preferably, the alkali metal polyphosphate is sodium tripolyphosphate ("STPP"). Most preferably, the alkali polyphosphate is STPP having a high phase-I crystalline structure, i.e., at least 65% phase-I. High phase-I crystalline STPP quickly forms a hexahydrate with water as compared to the phase-II isomer, which has a hexacoordinate structure. High phase-I STPP also undergoes fast and uniform hydration, forming small, well-dispersed STPP.6$H_2O$ crystals.

Inorganic and organic non-phosphate detergent builder salts may also be used in the present detergent composition. Illustrative examples of suitable inorganic non-phosphate builder salts include alkali metal borates, carbonates and bicarbonates and water insoluble aluminosilicates or zeolitias, both crystalline and amorphous. Specific examples include sodium tetraborate, sodium carbonate, sodium bicarbonate, sodium sesquicarbonate, potassium bicarbonate, and sodium and potassium zeolites. Illustrative examples of suitable organic non-phosphate builder salts include alkali metal salts of polycarboxylic acids and nitriloacetic acid. Specific examples include monosodium, disodium and trisodium citrate and tetrasodium ethylenediaminetetraacetic acid ("EDTA"). Mixtures of alkali polyphosphates and conventional organic and/or inorganic builder salts may also be employed.

Since the compositions of the invention are generally highly concentrated and therefore may be used in relatively small amounts, it is preferable to supplement any polyphosphate builder salts, such as STPP, with an auxiliary builder such as an alkali metal polycarboxylic acid salt. Suitable alkali metal polycarboxylic acids are alkali metal salts of citric acid and tartaric acid. The sodium salts of citric acid are preferred. Other auxiliary builder salts, such as the non-phosphate detergent builder salts generally known to the art, may also be used to supplement any polyphosphate builder salt.

The source of alkalinity employed may be any source of alkalinity known to those skilled in the art for use in detergent compositions. Preferably, the source of alkalinity is an alkali metal hydroxide, such as potassium hydroxide or sodium hydroxide. More preferably, the source of alkalinity is sodium hydroxide. The amount of the source of alkalinity employed is sufficient to raise the pH of the concentrated liquid warewash composition to an effective level for institutional and/or industrial cleaning applications. In a particularly preferred embodiment, the amount of sodium hydroxide employed is about 8% to about 50% by weight of the detergent composition, more preferably about 15% to about 40% by weight.

The surface active agent employed may be any of the known anionic, nonionic, cationic and amphoteric surfactants, or mixtures thereof, which are stable to the source of alkalinity and, when optionally present, the chlorine bleach compound.

Preferred anionic surfactants include the linear or branched alkali metal mono- and/or di-($C_8$–$C_{14}$) alkyl diphenyl oxide mono- and/or di-sulfonates which are commercially available from Dow Chemical Company under the DOWFAX™ trademark. Most preferably, DOWFAX™ 3B2 and DOWFAX™ 2A1 are used as anionic surface active agents. Other suitable anionic surfactants include the primary alkyl sulfates, alkyl sulfonates, arylalkylsulfonates and sec.alkylsulfonates. Illustrative examples of these surfactants include sodium $C_{10}$–$C_{18}$ alkylsulfates such as sodium dodecylsulfate, sodium alkylsulfonates such as sodium hexadecyl-1-sulfonate, and sodium $C_{12}$–$C_{18}$ alkylbenzenesulfonates such as sodium dodecylbenzenesulfonate. The corresponding potassium salts may also be used.

Preferred nonionic surfactants are the low foam surfactants. A preferred group of such nonionic surfactants is the poly-lower alkoxylated higher alkanols, in which the alkanol contains 9 to 18 carbon atoms and the number of moles of lower alkylene oxide (2 or 3 carbon atoms) is from 3 to 12. Illustrative examples of suitable nonionic surfactants include the low foam PLURAFAC™ series from BASF Chemical Company, which are the reaction product of a higher linear alcohol and a mixture of propylene and ethylene oxides, containing a mixed chain of propylene oxide and ethylene oxide, terminated by a hydroxy group. Specific examples include a $C_{13}$–$C_{15}$ fatty alcohol condensed with 6 moles of ethylene oxide and 3 moles of propylene oxide and a $C_{13}$–$C_{15}$ fatty alcohol condensed with 7 moles of propylene oxide and 4 moles of ethylene oxide. Particularly good surfactants are PLURAFAC™ LF 132 and PLURAFAC™ LF 231, which are capped, and PLURAFAC™ RA 40 and PLURAFAC™ RA 30, which are linear alcohol alkoxylates with varying amounts of ethylene oxide and propylene oxide. A particularly preferred nonionic surfactant is PLURONIC™ 25R2, which is a block copolymer manufactured by BASF.

Other illustrative useful nonionic surfactants include NEODOL™ 25-7 and NEODOL™ 25-6.5 from Shell Chemical Company, Inc. The former is a condensation product of a mixture of higher fatty alcohols averaging about 12 to 15 carbon atoms with about 7 moles of ethylene oxide. The latter is a corresponding mixture in which the higher fatty alcohols have 12 or 13 carbon atoms and the number of ethylene oxide groups averages about 6.5 moles. The higher alcohols are primarily alkanols.

Additional illustrative nonionic surfactants include TERGITOL™ 15-S-7 and TERGITOL™ 15-S-9, which are both linear secondary alcohol ethoxylates, and TERGITOL™ MDS-42, a linear alcohol having randomly distributed ethoxy and propoxy groups, all of which are sold by Union Carbide Corporation. Other useful nonionic surfactants include the POLY-TERGENT™ S-LF surfactants LAW OFFICES from Olin Corporation. The POLY-TERGENT™ surfactants are low foaming, biodegradable alkoxylated linear fatty alcohols, and include POLY-TERGENT™ S-LF 18, POLY-TERGENT™ S-303-LF, POLY-TERGENT™ S-405 LF and CS-1. POLY-TERGENT™ S-LF 18 and POLY-TERGENT™ CS-1 are particularly preferred.

Alkylpolysaccharide surfactants having a hydrophobic group containing about 8 to about 20 carbon atoms may also be employed. Preferably, these surfactants contain about 10 to 16 carbon atoms, most preferably 12 to 14 carbon atoms, and 1.5 to about 10 saccharide units, e.g., fructosyl, glucosyl and galactosyl units. Mixtures of saccharides may also be used. Examples of suitable alkylpolysaccharide surfactants include the APG™ glycoside surfactants, such as APG™ 25 and APG™ 625, which are available from Henkel Corporation and are characterized by the general formula $C_nH_{2n+1}O(C_6H_{10}O_5)_xH$.

The amount of surface active agent employed is preferably about 0% to about 5% by weight of the composition. More preferably, about 0% to about 3% by weight of the surface active agent is used. A mixture of two or more of the liquid surface active agents may also be used.

The neutralized crosslinked hydrophilic polycarboxylate thickening agent may be any of the crosslinked polyacrylic acid-type thickening agents known to those skilled in the art. As used herein, "polyacrylic acid-type" is intended to refer to water soluble homopolymers of acrylic acid or methacrylic acid or water-dispersible or water-soluble salts, esters and amides thereof, or water-soluble copolymers of these acids or their salts, esters or amides with each other or with one or more ethylenically unsaturated monomers, such as styrene, maleic acid, maleic anhydride, 2-hydroxyethylacrylate, acrylonitrile, vinyl acetate, ethylene, propylene or the like. The neutralized crosslinked hydrophilic polycarboxylate thickening agent may be crosslinked with 0.01 to 1.5% of a monomeric crosslinking agent.

Preferably, the polycarboxylate thickening agent is one of the crosslinked polyacrylic acid-type thickening agents commercially available from B.F. Goodrich under the CARBOPOL™ trademark. The CARBOPOL™ resins, also known as carbomer resins, are hydrophilic, high molecular weight, crosslinked acrylic acid polymers having an average equivalent weight of about 76 and a general structure of the formula:

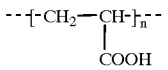

The CARBOPOL™ resins are crosslinked with a polyalkenyl polyether, such as a polyalkyl ether of sucrose having an average of 5.8 allyl groups per molecule of sucrose. The crosslinking may be performed-by any of the methods known to the chemical arts, such as by irradiation or by incorporating a crosslinking agent such as divinylbenzene into the monomer mixture before polymerization.

Preferably, the crosslinked polycarboxylate thickening agent is CARBOPOL™ 672 or 695, each of which has an average molecular weight of about 3,000,000. CARBOPOL™ 690 and 675, each of which has an average molecular weight of about 4,000,000, are also preferred.

The amount of polycarboxylate thickening agent employed is preferably about 0.1% to about 2% by weight of the detergent composition. More preferably, about 0.1% to about 1.5% by weight, most preferably about 0.2% to about 1.0%, of the polycarboxylate thickening agent is used.

Other organic and inorganic thickeners, and mixtures thereof, may also be used in the present invention in conjunction with the polycarboxylate thickening agent. For example, thickeners such as finely divided silica may be employed. Illustrative examples of suitable silicas include CAB-O-SIL™ M5, CAB-O-SIL™ TS720 and AEROSIL™ 200. Mixtures of finely divided silicas and nonionic associative thickeners, such as DAPRAL™ T210 and DAPRAL™ T212 from Akzo or PLURACOL™ TH 916 and PLURACOL™ TH 922 from BASF, may be used. Blends of organoclay gel, such as BENTONE™ NL27 from NL Chemical, and hydroxypropyl cellulose polymer, such as KLUCEL™ M cellulose from Aqualon Company, may also be employed. Inorganic clay, such as VANGEL™ C, VANGEL™ 0 and VANGEL™ ES from Vanderbilt Company and GEL WHITE™ GP from Southern Clay Products, may also be used.

The hydrogen bonding agent for the neutralized crosslinked hydrophilic polycarboxylate is preferably a fatty acid stabilizer or salts or mixtures thereof known by those skilled in the art for use in detergent compositions. Preferably, the fatty acid stabilizer employed is a long chain fatty acid, having about 8 to about 22 carbon atoms. More preferably, the fatty acid has about 10 to about 20 carbon atoms, most preferably about 12 to about 18 carbon atoms. The fatty acid chain may be straight or branched and may be saturated or unsaturated. Preferably, the fatty acid is a straight chain saturated fatty acid. Most preferably, the fatty acid stabilizer is stearic acid. A particularly preferred stearic acid is commercially available as Industrene™ 8718 from Witco Chemicals.

The amount of hydrogen bonding agent employed is preferably about 0.1% to about 2% by weight. Most preferably, about 0.1% to about 1% by weight of the hydrogen bonding agent is employed to provide long term stability and absence of separation upon standing or during transportation at both low and elevated temperatures.

In connection with the alkali metal detergent builder salt, a noncrosslinked polyacrylate may optionally be employed as a builder assist and performance additive. This polyacrylate may be a homopolymer or copolymer of acrylic acid or methacrylic acid and preferably has a molecular weight between about 1,000 and about 100,000, more preferably between about 2,000 and about 80,000, most preferably about 4500.

Water soluble salts of acrylic acid and methacrylic acid homopolymers are particularly preferred for use in the present invention. The water soluble salts may be an alkali metal salt, such as a potassium or sodium salt, an ammonium salt or a substituted ammonium salt. The salt may be in partially or fully neutralized form. Also, partial neutralization and esterification of the carboxylic acid groups may be performed while maintaining the efficacy of the homopolymer.

Suitable low molecular weight polyacrylates are commercially available. For example, the low molecular weight noncrosslinked polyacrylates available from Rohm and Haas under the ACUSOL™ trademark are particularly preferred. Most particularly preferred is ACUSOL™ 445N, which has a molecular weight of about 4,500.

A mixture of an acrylic acid homopolymer and a maleic/olefin copolymer may also be used as the noncrosslinked polyacrylate. The copolymer may be derived from a substituted or unsubstituted maleic anhydride and a lower olefin in place of all or a portion of the cyclic anhydride. Preferably, the maleic anhydride monomer is of the general formula:

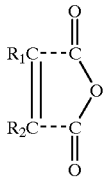

where $R_1$ and $R_2$ are, independently, H, $(C_1–C_4)$alkyl, phenyl, $(C_1–C_4)$alkylphenyl or phenyl$(C_1–C_4)$alkylene; most preferably $R_1$ and $R_2$ are each H. The lower olefin component is preferably a $(C_2–C_4)$olefin, such as ethylene, propylene, isopropylene, butylene or isobutylene, and most preferably is ethylene. The copolymers may vary in molecular weight from about 1000 to about 100,000; preferred copolymers are those having a molecular weight of about 1,000 to 50,000. For example, ACUSOL™ 460N, which has a molecular weight of about 15,000, is particularly preferred. Other illustrative copolymers include SOKALAN™ CP45, which is a partially neutralized copolymer of a methacrylic acid and maleic anhydride sodium salt, and SOKALAN™ CP5, which is a fully neutralized salt.

These water soluble noncrosslinked polyacrylate polymers, either alone or in combination, may be preferably used in any amount of about 0 to about 15%, more preferably about 0 to about 10%.

A chlorine bleach compound is also preferably included in the inventive detergent composition. Any of the chlorine bleach compounds known to the art to generate hypochlorite upon contact with or dissolution in water may employed in the present invention. Illustrative examples of suitable chlorine bleach compounds include alkali metal and alkaline earth metal hypochlorites, such as sodium or calcium hypochlorite, N-chlorimides and salts thereof, such as trichloroisocyanuric acid, sodium dichloroisocyanurate, N-chlorosuccinimide, N-chlorophthalimide, chloramine-B, chloramine-T and chlorinated trisodium phosphate and hydantoins such as 1,3-dichloro-5,5-dimethylhydantoin.

Preferably, the chlorine bleach compound is an alkali metal or alkaline earth metal hypochlorite, most preferably sodium hypochlorite. The chlorine bleach compound may additionally be stabilized with, for example, sulfamic acid or potassium iodate. Preferably, the chlorine bleach compound is stabilized with sulfamic acid or a derivative thereof, such as benzene sulfonamide or p-toluene sulfonamide.

The composition should contain a sufficient amount of the chlorine bleach compound to provide 0% to 5% by weight of available chlorine, as determined, for example, by acidification of the inventive composition with excess sulfuic acid and iodometric titration with sodium thiosulfate, either manually or monitored by a potentiometer. Preferably, the inventive composition contains about 0% to about 3% by weight of available chlorine, more preferably about 0% to about 2.5% by weight of available chlorine.

The inventive composition further preferably contains a foam depressant. Any of the compatible materials known to the art to inhibit or prevent foaming during wash cycles may be employed. Preferred foam depressants include the silicone foam depressants. Illustrative silicone foam depressants include the alkylated polysiloxanes, such as polydimethyl siloxanes, polydiethyl siloxanes, phenyl methyl siloxanes and trimethylated silanted silica. Specific examples include Silicone L7604™ and TP201™ from Union Carbide Corporation and Silicone DB100™ from Dow Corning Corporation.

It is generally preferred to include a chlorine bleach stable foam depressant or inhibitor. Particularly effective are the alkyl phosphonic acid esters or phosphate esters as represented by the general formula:

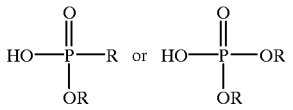

specific examples of which include PCUK-PAE™ (BASF), SAP™ (Hooker) and $LPK_n$-158™ (Knapsack), in which one or both R groups in each type of the ester is a $C_{12}$–$C_{20}$ alkyl group. Especially preferred is a mixture of mono- and di-$C_{16}$–$C_{18}$ alkyl acid phosphate esters, such as mono stearyl/distearyl acid phosphates 1.2/1 ($LPK_n$-158™ from Knapsack). Preferably 3 to 4%, more preferably 0 to 2% and most preferably 0 to 1%, of the foam depressant or inhibitor may be employed.

The remainder of the inventive detergent (i.e., to give 100% by weight) is water, preferably deionized water. Other conventional ingredients may also be included in the inventive compositions as desired. For example, perfume, hydrotropic agents, preservatives, dyestuffs, pigments and the like may be included, provided that they are stable in a highly alkaline environment, and, when present in the chlorine bleach.

The present inventive detergent composition may be prepared according to any of the methods known to the art, such as disclosed in U.S. Pat. No. 5,252,241, the disclosure of which is herein incorporated by reference. Preferably, the composition is prepared by first forming a dispersion of the polycarboxylate thickening agent in water under moderate to high shear conditions, neutralizing the dispersed polymer to cause gelation, and then introducing, while continuing mixing, the alkali polyphosphate, the source of alkalinity, polyacrylate polymer, the hydrogen bonding agent, the surface active agent and the chlorine bleach compound. These ingredients may be introduced sequentially or simultaneously. Preferably, these ingredients are added sequentially, although it is not necessary to complete the addition of one ingredient before commencing addition of another ingredient. Moreover, one or more of these ingredients can be divided into portions and added at different times. The mixing should preferably be performed under moderate to high shear rates to achieve complete and uniform mixing of the ingredients.

The remaining ingredients, including the surface active agent and the fatty acid stabilizer, are then added in the form of an aqueous emulsion to the previously formed mixture. Prior to addition, the aqueous emulsion is preferably heated to a temperature sufficient to melt the fatty acid stabilizer to ensure the formation of a uniform emulsion. Preferably, the chlorine bleach compound, if employed, is added last after cooling the mixture to ambient temperature to extend the shelf life of the chlorine bleach.

The present invention also provides a method for cleaning and destaining dishwares, tablewares including flatwares, glasswares, plates and pans in a warewash machine with an aqueous wash bath containing an effective amount of the concentrated liquid gel warewash detergent composition as described above. The composition can be readily and accurately dispensed into a warewash machine by a metered device such as peristaltic pump and will be sufficiently predissolved such that the hot water spray will quickly form a detergent solution for effective cleaning performance.

The following examples of the inventive composition were prepared in a manner substantially similar to the formulating protocol described above. These examples are merely illustrative of the invention and should not be construed as limiting. One skilled in the art can make, without undue experimentation, various substitutions and variations and by equivalent means, performing in substantially the same manner, obtain substantially the same results without departing from the teaching and spirit of the invention.

TABLE 1

CHLORINATED WARE WASH LIQUID GEL
CHEMICAL & PHYSICAL STABILITY DATA

| Ingredients | 75-1 | 75-2 | 75-3 | 76-1 | 76-2 | 76-3 | 79-1 | 79-2 | 79-3 | 79-4 |
|---|---|---|---|---|---|---|---|---|---|---|
| Carbopol 672 | 0.40 | 0.40 | 0.40 | 0.45 | 0.40 | 0.40 | 0.40 | 0.40 | 0.40 | 0.40 |
| Deionized Water | 14.80 | 14.80 | 14.80 | 16.55 | 14.80 | 14.80 | 14.80 | 14.80 | 14.80 | 14.80 |
| Sodium Hydroxide (50%) | 15.00 | 15.00 | 15.00 | 15.00 | 15.00 | 15.00 | 15.00 | 15.00 | 15.00 | 15.00 |

TABLE 1-continued

CHLORINATED WARE WASH LIQUID GEL
CHEMICAL & PHYSICAL STABILITY DATA

| Ingredients | 75-1 | 75-2 | 75-3 | 76-1 | 76-2 | 76-3 | 79-1 | 79-2 | 79-3 | 79-4 |
|---|---|---|---|---|---|---|---|---|---|---|
| Sodium Tripolyphosphate-Anhydrous | 15.00 | 15.00 | 15.00 | 15.00 | 15.00 | 15.00 | 15.00 | 15.00 | 15.00 | 15.00 |
| Sodium Hydroxide (50%) | 25.00 | 25.00 | 25.00 | 27.00 | 27.00 | 25.00 | 25.00 | 25.00 | 25.00 | 25.00 |
| Sulfamic Acid | 2.90 | 5.80 | 8.70 | 2.90 | 2.90 | 2.90 | 2.88 | 1.44 | 0.72 | 0.36 |
| Stearic Acid (Industrene 8718) | 0.10 | 0.10 | 0.10 | 0.10 | 0.10 | 0.10 | 0.10 | 0.10 | 0.10 | 0.10 |
| Dowfax 3B2 (45%) | 1.00 | 1.00 | 1.00 | 1.00 | 1.00 | 1.00 | 1.00 | 1.00 | 1.00 | 1.00 |
| Deionized Water | 5.80 | 2.90 | 0.00 | 0.00 | 1.80 | 2.80 | 5.82 | 7.26 | 7.98 | 8.34 |
| Sodium Polyacrylate (Acusol 445N, 45%) | 5.00 | 5.00 | 5.00 | 7.00 | 7.00 | 8.00 | 5.00 | 5.00 | 5.00 | 5.00 |
| Sodium Hypochlorite (15%) | 15.00 | 15.00 | 15.00 | 15.00 | 15.00 | 15.00 | 15.00 | 15.00 | 15.00 | 15.00 |
| Total | 100.00 | 100.00 | 100.00 | 100.00 | 100.00 | 100.00 | 100.00 | 100.00 | 100.00 | 100.00 |
| Available Chlorine (Fresh) | 2.11 | 2.12 | 2.00 | 1.96 | 1.92 | 2.05 | 1.92 | | | |
| Viscosity (Brookfield, 20 rpm, #4 Spindle) (Fresh) | 8000 | 6500 | 9200 | 6700 | 6000 | 4500 | 6800 | | | |

20

TABLE 2

CHLORINATED WARE WASH LIQUID GEL
CHEMICAL & PHYSICAL STABILITY DATA

| Ingredients | 80-1 | 80-2 | 80-3 | 80-4 | 81-1 | 81-2 | 81-3 | 81-4 | 81-5 | 81-6 |
|---|---|---|---|---|---|---|---|---|---|---|
| Carbopol 672 | 0.40 | 0.40 | 0.40 | 0.40 | 0.40 | 0.40 | 0.40 | 0.40 | 0.40 | 0.40 |
| Deionized Water | 14.80 | 14.80 | 14.80 | 14.80 | 14.80 | 14.80 | 14.80 | 14.80 | 14.80 | 14.80 |
| Sodium Hydroxide (50%) | 15.00 | 15.00 | 15.00 | 15.00 | 15.00 | 15.00 | 15.00 | 15.00 | 15.00 | 15.00 |
| Sodium Tripolyphosphate-Anhydrous | 15.00 | 15.00 | 15.00 | 15.00 | 15.00 | 15.00 | 15.00 | 15.00 | 15.00 | 15.00 |
| Sodium Hydroxide (50%) | 26.00 | 26.00 | 26.00 | 26.00 | 25.00 | 25.00 | 25.00 | 26.00 | 26.00 | 26.00 |
| Sulfamic Acid | 3.20 | 1.60 | 0.80 | 0.40 | 4.60 | 3.45 | 2.30 | 5.05 | 3.79 | 2.53 |
| Stearic Acid (Industrene 8718) | 0.10 | 0.10 | 0.10 | 0.10 | 0.10 | 0.10 | 0.10 | 0.10 | 0.10 | 0.10 |
| Dowfax 3B2 (45%) | 1.00 | 1.00 | 1.00 | 1.00 | 1.00 | 1.00 | 1.00 | 1.00 | 1.00 | 1.00 |
| Deionized Water | 1.50 | 3.10 | 3.90 | 4.30 | 4.10 | 5.25 | 6.40 | 0.00 | 0.91 | 2.17 |
| Sodium Polyacrylate (Acusol 445N, 45%) | 6.50 | 6.50 | 6.50 | 6.50 | 5.00 | 5.00 | 5.00 | 6.50 | 6.50 | 6.50 |
| Sodium Hypochlorite (15%) | 16.50 | 16.50 | 16.50 | 16.50 | 15.00 | 15.00 | 15.00 | 16.50 | 16.50 | 16.50 |
| Total | 100.00 | 100.00 | 100.00 | 100.00 | 100.00 | 100.00 | 100.00 | 100.00 | 100.00 | 100.00 |
| Available Chlorine (Fresh) | 2.12 | | | | 2.02 | 2.00 | 1.76 | 2.17 | 2.16 | 1.81 |
| Viscosity (Brookfield, 20 rpm, #4 Spindle) (Fresh) | | | | | | | | | | |

TABLE 3

CHLORINATED WARE WASH LIQUID GEL
CHEMICAL & PHYSICAL STABILITY DATA

| Ingredients | 83-1 | 83-2 | 83-3 | 83-4 | 83-5 | 84-1 | 84-2 | 84-3 | 84-4 | 84-5 |
|---|---|---|---|---|---|---|---|---|---|---|
| Carbopol 672 | 0.50 | 0.50 | 0.50 | 0.50 | 0.50 | 0.50 | 0.50 | 0.50 | 0.50 | 0.50 |
| Deionized Water | 18.50 | 18.50 | 18.50 | 18.50 | 18.50 | 17.50 | 17.50 | 17.50 | 17.50 | 17.50 |
| Sodium Hydroxide (50%) | 15.00 | 15.00 | 15.00 | 15.00 | 15.00 | 15.00 | 15.00 | 15.00 | 15.00 | 15.00 |
| Sodium Tripolyphosphate-Anhydrous | 15.00 | 15.00 | 15.00 | 15.00 | 15.00 | 15.00 | 15.00 | 15.00 | 15.00 | 15.00 |
| Sodium Hydroxide (50%) | 25.00 | 25.00 | 25.00 | 25.00 | 25.00 | 25.00 | 25.00 | 25.00 | 25.00 | 25.00 |
| Sulfamic Acid | 3.00 | 3.00 | 3.00 | 3.00 | 3.00 | 3.00 | 3.00 | 3.00 | 3.00 | 3.00 |
| Stearic Acid (Industrene 8718) | 0.10 | 0.10 | 0.00 | 0.00 | 0.10 | 0.10 | 0.15 | 0.20 | 0.25 | 0.30 |
| Dowfax 3B2 (45%) | 1.00 | 1.00 | 1.00 | 0.00 | 0.00 | 1.00 | 1.00 | 1.00 | 1.00 | 1.00 |
| Deionized Water | 1.90 | 0.00 | 0.00 | 0.00 | 0.00 | 0.90 | 0.85 | 0.80 | 0.75 | 0.70 |
| Sodium Polyacrylate (Acusol 445N, 45%) | 5.00 | 6.90 | 7.00 | 8.00 | 7.90 | 7.00 | 7.00 | 7.00 | 7.00 | 7.00 |
| Sodium Hypochlorite (15%) | 15.00 | 15.00 | 15.00 | 15.00 | 15.00 | 15.00 | 15.00 | 15.00 | 15.00 | 15.00 |
| Total | 100.00 | 100.00 | 100.00 | 100.00 | 100.00 | 100.00 | 100.00 | 100.00 | 100.00 | 100.00 |
| Available Chlorine (Fresh) | 2.11 | 2.11 | 2.17 | 2.08 | 2.11 | 2.10 | 2.05 | 2.00 | 2.10 | 2.10 |
| Viscosity (Brookfield, 20 rpm, | | | | | | 14500 | 15200 | 13600 | 14000 | 11000 |

TABLE 3-continued

CHLORINATED WARE WASH LIQUID GEL
CHEMICAL & PHYSICAL STABILITY DATA

| Ingredients | 83-1 | 83-2 | 83-3 | 83-4 | 83-5 | 84-1 | 84-2 | 84-3 | 84-4 | 84-5 |
|---|---|---|---|---|---|---|---|---|---|---|
| #4 Spindle) (Fresh) | | | | | | | | | | |
| Aging Data | | | | | | | | | | |
| Phase Separation (Ambient, 7 Days) | 0 | 0 | 0 | 0 | 0 | 0 | 0 | 0 | 0 | 0 |
| Phase Separation (110° F., 7 Days), % | 15 | 0 | 16 | 21 | 19 | | | | | |
| Phase Separation (Ambient, 23 Days) | 0 | 0 | 0 | 0 | 0 | 0 | 0 | 0 | 0 | 0 |
| Phase Separation (110° F., 23 Days) % | 29 | 26 | 32 | 31 | 29 | Yes | Yes | Yes | Yes | Yes |

TABLE 4

CHLORINATED WARE WASH LIQUID GEL
CHEMICAL & PHYSICAL STABILITY DATA

| Ingredients | 91-1 | 91-2 | 91-3 | 91-4 | 91-5 | 91-6 | 91-7 | 91-8 | 91-9 | 91-10 |
|---|---|---|---|---|---|---|---|---|---|---|
| Carbopol 672 | 0.50 | 0.50 | 0.50 | 0.50 | 0.50 | 0.56 | 0.56 | 0.56 | 0.56 | 0.56 |
| Deionized Water | 17.50 | 17.50 | 17.50 | 17.50 | 17.50 | 19.44 | 19.44 | 19.44 | 19.44 | 19.44 |
| Sodium Hydroxide (50%) | 15.00 | 15.00 | 15.00 | 15.00 | 15.00 | 15.00 | 15.00 | 15.00 | 15.00 | 15.00 |
| Sodium Tripolyphosphate-Anhydrous | 15.00 | 15.00 | 15.00 | 15.00 | 15.00 | 15.00 | 15.00 | 15.00 | 15.00 | 15.00 |
| Sodium Hydroxide (50%) | 25.00 | 25.00 | 25.00 | 25.00 | 25.00 | 25.00 | 25.00 | 25.00 | 25.00 | 25.00 |
| Sulfamic Acid | 3.00 | 3.00 | 3.00 | 3.00 | 3.00 | 3.00 | 3.00 | 3.00 | 3.00 | 3.00 |
| Stearic Acid (Industrene 8718)* | 0.40 | 0.50 | 0.30 | 0.20 | 0.10 | 0.10 | 0.20 | 0.30 | 0.40 | 0.50 |
| Dowfax 3B2 (45%)* | 1.00 | 1.00 | 1.00 | 1.00 | 1.00 | 1.00 | 1.00 | 1.00 | 1.00 | 1.00 |
| Deionized Water* | 0.60 | 0.50 | 0.70 | 0.80 | 0.90 | 0.90 | 0.80 | 0.70 | 0.60 | 0.50 |
| Sodium Polyacrylate (Acusol 445N, 45%) | 7.00 | 7.00 | 7.00 | 7.00 | 7.00 | 5.00 | 5.00 | 5.00 | 5.00 | 5.00 |
| Sodium Hypochlorite (15%) | 15.00 | 15.00 | 15.00 | 15.00 | 15.00 | 15.00 | 15.00 | 15.00 | 15.00 | 15.00 |
| Total | 100.00 | 100.00 | 100.00 | 100.00 | 100.00 | 100.00 | 100.00 | 100.00 | 100.00 | 100.00 |
| Available Chlorine (Fresh) | 1.96 | 1.98 | 2.04 | 1.96 | 2.07 | 1.94 | 1.93 | 2.07 | 2.1 | 2.17 |
| Viscosity (Brookfield, 20 rpm, #4 Spindle) (Fresh) | 8000 | 8900 | 9000 | 9150 | 7550 | 8950 | 9500 | 19100 | 8650 | 9650 |
| Aging Data | | | | | | | | | | |
| Phase Separation (20 Days, Ambient & 100° F.) | 0 | 0 | 0 | 0 | 0 | 0 | 0 | 0 | 0 | 0 |
| Viscosity (30 Days, Ambient) | 14200 | 16900 | 19800 | 19900 | 32000 | 41000 | 47000 | 47000 | 45000 | 38000 |

*Stearic Acid melted and emulsified in Dowfax 3B2 and water

TABLE 5

NON-CHLORINATED WARE WASH LIQUID GEL
CHEMICAL & PHYSICAL STABILITY DATA

| Ingredients | 78-1 | 61-1 | 62-2 | 51-1 | 51-2 | 41-1 | 41-2 | 41-3 | 41-4 | 40-1 | 40-2 | 40-3 | 40-4 |
|---|---|---|---|---|---|---|---|---|---|---|---|---|---|
| Carbopol 672 | 0.50 | 0.50 | 0.40 | 0.60 | 0.70 | 0.50 | 0.50 | 0.25 | 0.25 | 0.50 | 0.50 | 0.25 | 0.25 |
| Deionized Water | 18.50 | 18.50 | 14.80 | 18.40 | 27.80 | 26.00 | 26.25 | 26.25 | 26.50 | 26.00 | 26.25 | 26.25 | 26.50 |
| Sodium Hydroxide (50%) | 15.00 | 15.00 | 15.00 | 20.00 | 20.00 | 20.00 | 20.00 | 20.00 | 20.00 | 50.00 | 50.00 | 50.00 | 50.00 |
| Sodium Tripoly-phosphate-Anhydrous | 15.00 | 15.00 | 15.00 | 15.00 | 15.00 | 15.00 | 15.00 | 15.00 | 15.00 | 15.00 | 15.00 | 15.00 | 15.00 |
| Sodium Hydroxide (50%) | 35.00 | 35.00 | 35.00 | 30.00 | 30.00 | 30.00 | 30.00 | 30.00 | 30.00 | 0.00 | 0.00 | 0.00 | 0.00 |
| Stearic Acid (Industrene 8718) | 0.10 | 0.10 | 0.10 | 0.50 | 0.50 | 0.50 | 0.25 | 0.50 | 0.25 | 0.50 | 0.25 | 0.50 | 0.25 |
| Dowfax 3B2 (45%) | 1.00 | 0.00 | 0.00 | 0.50 | 0.50 | 0.50 | 0.50 | 0.50 | 0.50 | 0.50 | 0.50 | 0.50 | 0.50 |
| Sodium Polyacrylate (Acusol 445N, 45%) | 8.00 | 8.00 | 8.00 | 7.50 | 7.50 | 7.50 | 7.50 | 7.50 | 7.50 | 7.50 | 7.70 | 7.50 | 7.50 |

TABLE 5-continued

NON-CHLORINATED WARE WASH LIQUID GEL
CHEMICAL & PHYSICAL STABILITY DATA

| Ingredients | 78-1 | 61-1 | 62-2 | 51-1 | 51-2 | 41-1 | 41-2 | 41-3 | 41-4 | 40-1 | 40-2 | 40-3 | 40-4 |
|---|---|---|---|---|---|---|---|---|---|---|---|---|---|
| Deionized Water | 6.897 | 7.90 | 11.70 | 7.50 | 0.00 | 0.00 | 0.00 | 0.00 | 0.00 | 0.00 | 0.00 | 0.00 | 0.00 |
| Graphtol Green | 0.003 | 0 | 0 | | | | | | | | | | |
| Total | 100.00 | 100.00 | 100.00 | 100.00 | 100.00 | 100.00 | 100.00 | 100.00 | 100.00 | 100.00 | 100.00 | 100.00 | 100.00 |
| Viscosity (Brookfield, 20 rpm #4 Spindle) (Fresh) | 9800 | 8000 | 5600 | >50000 | >50000 | >20000 | >20000 | 7100 | 5200 | 7450 | 6750 | 2650 | 2500 |
| Density (g/mL) | 1.41 | | | | | | | | | | | | |
| Solid Content, % | 44.2 | 44.2 | 44.1 | | 44.63 | | | | | | | | |
| Aging Data | | | | | | | | | | | | | |
| Phase Separation (90 Days at Ambient Temp.) | None | None | None | None | None | None | None | Yes | Yes | Yes | Yes | Yes | Yes |
| Phase Separation (90 Days at 110° F. Temp.) | None | None | None | None | None | Yes | Yes | Yes | Yes | Yes | Yes | Yes | Yes |
| Viscosity (30 Days) | 20000 | | | | | | | | | | | | |

TABLE 6

CHLORINATED WARE WASH LIQUID GEL
CHEMICAL & PHYSICAL STABILITY DATA

| Ingredients | 68-1 | 68-2 | 68-3 | 68-4 | 68-5 | 69-1 | 69-2 | 69-3 | 69-4 | 69-5 |
|---|---|---|---|---|---|---|---|---|---|---|
| Carbopol 672 | 0.50 | 0.50 | 0.50 | 0.50 | 0.50 | 0.50 | 0.50 | 0.50 | 0.50 | 0.50 |
| Deionized Water | 18.50 | 18.50 | 18.50 | 18.50 | 18.50 | 18.50 | 18.50 | 0.00 | 18.50 | 18.50 |
| Regular Water | 0.00 | 0.00 | 0.00 | 0.00 | 0.00 | 0.00 | 0.00 | 18.50 | 0.00 | 0.00 |
| Sodium Hydroxide (50%) | 15.00 | 15.00 | 15.00 | 15.00 | 15.00 | 15.00 | 15.00 | 15.00 | 15.00 | 15.00 |
| Sodium Tripolyphosphate-Anhydrous | 15.00 | 15.00 | 15.00 | 15.00 | 15.00 | 15.00 | 15.00 | 15.00 | 15.00 | 15.00 |
| Sodium Hydroxide (50%) | 25.00 | 25.00 | 25.00 | 25.00 | 25.00 | 25.00 | 25.00 | 25.00 | 25.00 | 25.00 |
| Stearic Acid (Industrene 8718) | 0.10 | 0.10 | 0.10 | 0.10 | 0.10 | 0.10 | 0.10 | 0.10 | 0.10 | 0.10 |
| Dowfax 3B2 (45%) | 1.00 | 1.00 | 1.00 | 0.00 | 0.50 | 1.00 | 1.00 | 1.00 | 1.00 | 1.00 |
| Deionized Water | 1.90 | 1.60 | 1.60 | 2.90 | 2.40 | 1.75 | 1.60 | 0.00 | 1.40 | 1.40 |
| Regular Water | 0.00 | 0.00 | 0.00 | 0.00 | 0.00 | 0.00 | 0.00 | 1.90 | 0.00 | 0.00 |
| Dequest 2010 | 0.00 | 0.30 | 0.00 | 0.00 | 0.00 | 0.15 | 0.00 | 0.00 | 0.00 | 0.50 |
| Dequest 2060 | 0.00 | 0.00 | 0.00 | 0.00 | 0.00 | 0.00 | 0.30 | 0.00 | 0.00 | 0.00 |
| Potassium Iodate | 0.00 | 0.00 | 0.30 | 0.00 | 0.00 | 0.00 | 0.00 | 0.00 | 0.50 | 0.00 |
| Sodium Polyacrylate (Acusol 445N, 45%) | 8.00 | 8.00 | 8.00 | 8.00 | 8.00 | 8.00 | 8.00 | 8.00 | 8.00 | 8.00 |
| Sodium Hypochlorite (15%) | 15.00 | 15.00 | 15.00 | 15.00 | 15.00 | 15.00 | 15.00 | 15.00 | 15.00 | 15.00 |
| Total | 100.00 | 100.00 | 100.00 | 100.00 | 100.00 | 100.00 | 100.00 | 100.00 | 100.00 | 100.00 |
| Available Chlorine | 1.99 | 1.99 | 2.30* | 1.98 | 1.97 | 2.12 | 1.98 | 2.02 | 2.53* | 1.8 |
| Viscosity (Brookfield, 20 rpm, #4 Spindle) (Fresh) | 5900 | 4100 | 5200 | 3500 | 4500 | 4500 | 2500 | 7700 | 15000 | 5000 |
| Density (g/mL) | 1.38 | 1.38 | 1.41 | 1.44 | 1.44 | 1.35 | 1.45 | 1.38 | 1.37 | 1.39 |
| Aging Data | | | | | | | | | | |
| Viscosity (20 Days, Ambient) | 14800 | 14800 | 14800 | 1400 | 14800 | 7300 | 1140 | 17000 | 23500 | 19800 |
| Phase Separation (35 Days, Ambient Temp.) | Yes | Yes | Yes | None | Yes | Yes | None | Yes | None | Yes |

*Additional contribution from K103

TABLE 7

CHLORINATED WARE WASH LIQUID GEL
CHEMICAL & PHYSICAL STABILITY DATA

| Ingredients | 45-1 | 45-2 | 45-3 | 45-4 | 45-5 | 47-1 | 47-2 | 47-3 | 50-1 | 50-2 |
|---|---|---|---|---|---|---|---|---|---|---|
| Carbopol 672 | 0.70 | 0.70 | 0.70 | 0.70 | 0.70 | 0.60 | 0.60 | 0.60 | 0.60 | 0.60 |
| Regular Water | 27.80 | 27.80 | 27.80 | 27.80 | 28.80 | 18.40 | 18.40 | 18.40 | 18.40 | 18.40 |
| Sodium Hydroxide (50%) | 20.00 | 20.00 | 20.00 | 20.00 | 20.00 | 20.00 | 20.00 | 20.00 | 20.00 | 20.00 |
| Sodium Tripolyphosphate-Anhydrous | 15.00 | 15.00 | 15.00 | 15.00 | 15.00 | 15.00 | 15.00 | 15.00 | 15.00 | 15.00 |
| Sodium Hydroxide (100%) | 14.00 | 14.00 | 14.00 | 14.00 | 14.00 | 14.00 | 14.00 | 14.00 | 14.00 | 13.50 |
| Stearic Acid (Industrene 8718) | 0.50 | 0.50 | 0.50 | 0.50 | 0.50 | 0.50 | 0.50 | 0.50 | 0.50 | 0.50 |
| Dowfax 3B2 (45%) | 0.50 | 1.00 | 0.50 | 0.00 | 0.00 | 0.00 | 0.00 | 0.00 | 0.50 | 0.50 |
| Regular Water | 0.00 | 0.00 | 0.00 | 0.00 | 0.00 | 10.50 | 8.50 | 6.50 | 7.00 | 5.00 |
| Dequest 2010 | 0.00 | 0.00 | 0.00 | 0.00 | 0.00 | 0.00 | 0.00 | 0.00 | 0.50 | 0.50 |
| Sodium Xylene Sulfonate (40%) | 0.50 | 0.00 | 0.00 | 0.00 | 0.00 | 0.00 | 0.30 | 0.00 | 0.00 | 0.00 |
| Sodium Silicate (1:2.4, 47%) | 0.00 | 0.00 | 0.00 | 0.00 | 0.00 | 0.00 | 0.00 | 0.00 | 0.00 | 5.00 |
| Sodium Polyacrylate (Acusol 445N, 45%) | 5.00 | 5.00 | 5.50 | 6.00 | 5.00 | 5.00 | 5.00 | 5.00 | 7.50 | 5.00 |
| Sodium Hypochlorite (15%) | 16.00 | 16.00 | 16.00 | 16.00 | 16.00 | 16.00 | 18.00 | 20.00 | 16.00 | 16.00 |
| Total | 100.00 | 100.00 | 100.00 | 100.00 | 100.00 | 100.00 | 100.00 | 100.00 | 100.00 | 100.00 |
| Available Chlorine | 1.72 | 2.00 | 1.86 | 1.92 | 1.92 | 2.19 | 2.52 | 2.78 | 1.90 | 2.20 |
| Viscosity (Brookfield, 20 rpm, #4 Spindle) (Fresh) | 13000 | 11000 | 16900 | 32000 | 14000 | 7600 | | | 47000 | 47000 |
| Aging Data | | | | | | | | | | |
| Phase Separation (22 Days, Ambient Temp.) | Yes | Yes | Yes | None | Yes | Yes | Yes | Yes | Yes | Yes |

TABLE 8

CHLORINATED WARE WASH LIQUID GEL
CHEMICAL & PHYSICAL STABILITY DATA
COLOR STABILITY

| Ingredients | 85-1 | 85-2 | 85-3 | 85-4 | 85-5 |
|---|---|---|---|---|---|
| Carbopol 672 | 0.50 | 0.50 | 0.50 | 0.50 | 0.50 |
| Deionized Water | 17.50 | 17.50 | 17.50 | 17.50 | 17.50 |
| Graphtol Green 5869-3 | 0.003 | | | | |
| Graphtol Yellow 4813-3 | | 0.003 | | | |
| Pyrazol Yellow BG 250 | | | 0.003 | | |
| Pylaklor Yellow Lx 10192 | | | | 0.003 | |
| Pylaklor Birght Yellow 326931 | | | | | 0.003 |
| Sodium Hydroxide (50%) | 15.00 | 15.00 | 15.00 | 15.00 | 15.00 |
| Sodium Tripolyphosphate-Anhydrous | 15.00 | 15.00 | 15.00 | 15.00 | 15.00 |
| Sodium Hydroxide (50%) | 25.00 | 25.00 | 25.00 | 25.00 | 25.00 |
| Sulfamic Acid | 3.00 | 3.00 | 3.00 | 3.00 | 3.00 |
| Stearic Acid (Industrene 8718) | 0.20 | 0.20 | 0.20 | 0.20 | 0.20 |
| Dowfax 3B2 (45%) | 1.00 | 1.00 | 1.00 | 1.00 | 1.00 |
| Deionized Water | 0.797 | 0.797 | 0.797 | 0.797 | 0.797 |
| Sodium Polyacrylate (Acusol 445N, 45%) | 7.00 | 7.00 | 7.00 | 7.00 | 7.00 |
| Sodium Hypochlorite (15%) | 15.00 | 15.00 | 15.00 | 15.00 | 15.00 |
| Total | 100.00 | 100.00 | 100.00 | 100.00 | 100.00 |
| Available Chlorine (Fresh) | 1.96 | 1.99 | 1.95 | 1.95 | 2.02 |
| Aging Data | | | | | |
| Color Stability (Ambient, 30 days) | Stable | Faded | Stable | Stable | Stable |
| Color Stability (100° F., 30 Days) | Stable | Faded | Stable | Stable | Stable |
| Phase Separation (Ambient, 30 Days) | None | None | None | None | None |
| Phase Separation (100° F., 30 Days) | Yes | No | Yes | Yes | Yes |

Although preferred embodiments of the invention are described herein in detail, it will be understood by those skilled in the art that variations may be made thereto without departing from the spirit of the invention or the scope of the appended claims.

What is claimed is:

1. A concentrated liquid gel warewash detergent composition for institutional or industrial cleaning applications comprising:

(a) about 5% to about 30% by weight of an alkali metal detergent builder salt;

(b) about 15% to about 50% by weight of an alkali metal hydroxide sufficient to raise the pH of the concentrated liquid gel warewash detergent composition to an effective level for institutional or industrial cleaning applications;

(c) about 0% to about 5% water dispersible or water soluble organic surface active agent;

(d) about 0.1% to 2% by weight of a neutralized crosslinked hydrophilic polycarboxylate thickening agent having a molecular weight from about 1,000,000 to about 4,000,000;

(e) about 0.1% to about 2% by weight of a hydrogen bonding agent is a long carbon chain fatty acid or metal salt of a fatty acid having about 8 to 22 carbon atoms;

(f) greater than 0% to about 15% by weight of a non-crosslinked polyacrylate having a molecular weight of about 1,000 to about 100,000;

(g) an amount of a chlorine bleach compound effective to provide greater than 0% and to about 5% by weight of available chlorine; and the balance being water, wherein substantially all of the solid components of the composition are dissolved in the aqueous phase and substantially all of the water in the composition is bound to said neutralized crosslinked polycarboxylate thickening agent, and further wherein the institutional or industrial cleaning applications have a wash time of less than one minute.

2. The composition according to claim 1, wherein said chlorine bleach compound is sodium hypochlorite.

3. The composition according to claim 1, wherein said source of alkalinity is sodium hydroxide.

4. The composition according to claim 1, wherein said alkali metal detergent builder salt is selected from alkali metal tripolyphosphate, alkali metal pyrophosphate, alkali metal metaphosphate, alkali metal carbonate, alkali metal bicarbonate, alkali metal citrate, alkali metal nitrilotriacetate, alkali metal zeolite, alkali metal EDTA or mixtures thereof.

5. The composition according to claim 4, wherein said alkali metal detergent builder salt is sodium tripolyphosphate.

6. The composition according to claim 1, wherein said neutralized polycarboxylate thickening agent is selected from acrylic acid or methacrylic acid, water dispersible or water soluble salts, esters, or amides thereof, or water soluble copolymers of these acids or their salts, esters or amides with each other or with one or more other ethylenically unsaturated monomers, said neutralized polycarboxylate thickening agent being crosslinked with 0.01 to 1.5% of a monomeric crosslinking agent.

7. The composition according to claim 1, wherein said surface active agent is selected from non-soap anionic surfactants, nonionic surfactants, cationic surfactants and amphoteric surfactants.

8. The composition according to claim 7, wherein said surface active agent is an anionic alkali metal mono- or di-($C_8$–$C_{14}$) alkyl diphenyl oxide mono- and/or di-sulfonate.

9. The composition according to claim 1, wherein said noncrosslinked polyacrylate is a linear homopolymer of acrylic acid having a molecular weight of about 4500.

10. The composition according to claim 1, wherein the source of alkalinity is potassium hydroxide or a mixture of sodium and potassium hydroxides.

11. The composition according to claim 1, wherein said alkali metal detergent builder salt is selected from sodium carbonate, sodium EDTA, Zeolite A, sodium nitrilotriacetate, sodium citrate, sodium hydrogen carbonate or mixtures thereof.

12. The composition according to claim 1, further comprising about 0% to about 4% by weight of a foam depressant.

13. The composition according to claim 4, wherein said alkali metal tripolyphosphate is potassium tripolyphosphate or a mixed salt of sodium potassium tripolyphosphate or a mixture of sodium and potassium tripolyphosphate.

14. The composition according to claim 1, wherein said fatty acid is stearic acid.

15. The composition according to claim 7, wherein said surface active agent is a nonionic surfactant.

16. The composition according to claim 2, wherein said chlorine bleach compound comprises sodium hypochlorite and a stabilizing amount of sulfamic acid or a derivative thereof.

17. A method for the institutional or industrial cleaning of soiled dishwares which comprises contacting said soiled dishwares with an aqueous wash bath having dissolved therein an effective amount of the composition according to claim 1, wherein the institutional or industrial cleaning method has a wash time of less than one minute.

* * * * *

UNITED STATES PATENT AND TRADEMARK OFFICE

CERTIFICATE OF CORRECTION

PATENT NO. : 5,981,457
DATED : November 9, 1999
INVENTOR(S) : Fahim AHMED et al.

It is certified that error appears in the above-identified patent and that said Letters Patent is hereby corrected as shown below:

IN THE CLAIMS:

Claim 16, col. 18, line 37, "claim 2" should read --claim 1--.

Signed and Sealed this

Sixth Day of June, 2000

*Attest:*

Q. TODD DICKINSON

*Attesting Officer*

*Director of Patents and Trademarks*